US011292020B2

(12) United States Patent
Duquet et al.

(10) Patent No.: US 11,292,020 B2
(45) Date of Patent: Apr. 5, 2022

(54) FLUID PRODUCT DISPENSER

(71) Applicant: APTAR FRANCE SAS, Le Neubourg (FR)

(72) Inventors: Frédéric Duquet, Crespières (FR); Francis Moreau, Sotteville les Rouen (FR)

(73) Assignee: APTAR FRANCE SAS, Le Neubourg (FR)

( * ) Notice: Subject to any disclaimer, the term of this patent is extended or adjusted under 35 U.S.C. 154(b) by 0 days.

(21) Appl. No.: 17/252,027

(22) PCT Filed: Jun. 28, 2019

(86) PCT No.: PCT/FR2019/051606

§ 371 (c)(1),
(2) Date: Dec. 14, 2020

(87) PCT Pub. No.: WO2020/002854

PCT Pub. Date: Jan. 2, 2020

(65) Prior Publication Data

US 2021/0252537 A1 Aug. 19, 2021

(30) Foreign Application Priority Data

Jun. 29, 2018 (FR) ..... 1855972

(51) Int. Cl.
*B05B 11/00* (2006.01)
*B05B 11/06* (2006.01)

(52) U.S. Cl.
CPC ..... *B05B 11/0035* (2013.01); *B05B 11/061* (2013.01)

(58) Field of Classification Search
CPC ..... B05B 11/0035; B05B 11/061; B05B 11/3028; B05B 9/0822; B05B 9/0816; G01F 11/084
See application file for complete search history.

(56) References Cited

U.S. PATENT DOCUMENTS 206,653 A * 7/1878 Weed ..... B05B 11/06 222/209
248,983 A * 11/1881 Beall ..... B05B 11/06 239/362

(Continued)

FOREIGN PATENT DOCUMENTS

DE 8 601 783 U1 6/1986
EP 230968 A * 8/1987 ..... B05B 9/0822

(Continued)

OTHER PUBLICATIONS

International search report for PCT/FR2019/051606 dated Nov. 18, 2019.

(Continued)

*Primary Examiner* — Vishal Pancholi
*Assistant Examiner* — Bob Zadeh
(74) *Attorney, Agent, or Firm* — Sughrue Mion, PLLC

(57) ABSTRACT

A fluid dispenser having:
a fluid reservoir (1);
an applicator (2); and a dispenser module (3) that is arranged between the reservoir (1) and the applicator (2); the fluid dispenser being characterized in that the dispenser module (3) includes an air pump (4) for sending air into the reservoir (1), and a fluid duct (54) connecting the reservoir (1) to the applicator (2).

21 Claims, 5 Drawing Sheets

(56) References Cited

U.S. PATENT DOCUMENTS

| | | | | | |
|---|---|---|---|---|---|
| 1,577,539 | A * | 3/1926 | Polk | G01F 11/084 | 215/309 |
| 1,776,489 | A * | 9/1930 | Cobb | B05B 11/062 | 222/633 |
| 1,808,662 | A * | 6/1931 | Kline | B05B 11/06 | 239/433 |
| 2,223,256 | A * | 11/1940 | Kross | A01J 11/12 | 222/400.8 |
| 3,940,030 | A | 2/1976 | Kondo | | |
| 7,140,522 | B2 * | 11/2006 | Kress | A45D 19/16 | 222/633 |
| 7,841,494 | B2 * | 11/2010 | Batinkoff | B05B 11/062 | 222/633 |
| 2013/0341359 | A1 * | 12/2013 | Vanier | A47G 19/2272 | 222/205 |

FOREIGN PATENT DOCUMENTS

| | | | |
|---|---|---|---|
| FR | 2 647 370 | A1 | 11/1990 |
| JP | 54-66210 | U | 5/1979 |
| WO | 2007/040133 | A1 | 4/2007 |
| WO | 2019/086592 | A1 | 5/2019 |

OTHER PUBLICATIONS

French International Preliminary Examination Report for PCT/FR2019/051606 dated Jun. 28, 2019.

International Preliminary Report on Patentability dated Dec. 30, 2020 from International Bureau in International Application No. PCT/FR2019/051606.

* cited by examiner

FLUID PRODUCT DISPENSER

CROSS-REFERENCE TO RELATED APPLICATIONS

This application is a National Stage of International Application No. PCT/FR2019/051606 filed Jun. 28, 2019, which claims priority under U.S.C. § 119(a) to French Patent Application No. 1855972 filed on Jun. 29, 2018.

The present invention relates to a fluid dispenser comprising a fluid reservoir, an applicator, and a dispenser module that is arranged between the reservoir and the applicator. Naturally, an advantageous field of application for the present invention is the field of cosmetics, but it may also be used in the fields of pharmacy, household cleaners, and foodstuffs.

In the prior art, numerous dispensers are already known that use a pump mounted on a fluid reservoir and supporting an applicator, the function of the pump being to take fluid by suction from the reservoir and to convey it under pressure to the applicator. The pump includes a pump chamber that is provided with an inlet valve and with an outlet valve, the fluid entering into the pump chamber via the inlet valve and leaving the pump chamber via the outlet valve. Document FR 2 978 684 describes a good example. In order to take the fluid from the reservoir, it is necessary for the pump to be fitted with a dip tube or for the reservoir to include a follower piston. Either way, when the reservoir is made out of a transparent material, the dip tube or the follower piston is visible.

In addition, in the prior art, it is also known to make some dispensers/applicators in the form of a pen, with a configuration that is generally elongate, so that they can be handled like a pen, which imparts increased accuracy in application. This is the situation in document FR 2 852 933, which describes a dispenser including a laterally-actuated pump in the form of a flexible sleeve on which the user presses with a finger, normally the index finger, so as to put fluid under pressure in a pump chamber. The drawback of that dispenser results from the fluid being directly in contact with the material constituting the flexible sleeve, which material may interact in harmful manner with the fluid. Specifically, it is known that the elastomers that are often used to manufacture flexible parts are likely to release compounds into the fluids with which they are in prolonged contact.

An object of the invention is thus to remedy the above-mentioned drawbacks of the prior art by defining another type of dispenser/applicator, in particular having a "pen" configuration, in which there is no longer any risk of fluid being contaminated or deteriorating as a result of the presence of elastomer or some other flexible material. Decorrelation between actuation and dispensing is also sought, for the purpose of smoothing or damping dispensing, which thus becomes more controllable and accurate. Another object of the invention is to empty the reservoir and the dispenser module completely.

To do this, the present invention proposes a fluid dispenser comprising:

- a fluid reservoir;
- an applicator; and
- a dispenser module that is arranged between the reservoir and the applicator;

the dispenser module including an air pump for sending air into the reservoir, and a fluid duct connecting the reservoir to the applicator.

Thus, the flow of air under pressure descends into the reservoir, and a portion of the fluid put under pressure in the reservoir by the air being injected under pressure rises into the fluid duct that passes through the dispenser module so as to feed the applicator. It can be said that the flows of air and fluid cross past each other within the dispenser module, which is arranged in central, middle, or interposed manner between the reservoir and the applicator.

Using an air pump also generates a kind of damping when dispensing the fluid, given that the air acts on the fluid and air is compressible. The user has a feeling of smoothness, given that the pressure exerted to actuate the air pump is not directly transmitted to the fluid.

Advantageously, the fluid dispenser may present a configuration that is elongate along a longitudinal axis X, the reservoir, the applicator, and the dispenser module extending along the longitudinal axis X, with the dispenser module interposed between the reservoir and the applicator. The configuration is thus typically a "pen" configuration.

According to an advantageous characteristic of the invention, the air pump may connect the reservoir through a one-way outlet valve. In addition, the air pump may connect the outside through a one-way inlet valve. Preferably, the one-way outlet valve and the one-way inlet valve are formed by a single-piece valve member.

In another advantageous aspect of the invention, the air pump includes a deformable actuator wall.

In an embodiment, the air pump may comprise a single-piece air expeller forming a pump chamber and a deformable actuator wall.

In a practical embodiment, the dispenser module may comprise:

- a module body forming the fluid duct and fastener means for fastening on the reservoir;
- a cover forming reception means for receiving the applicator; and
- the air pump in the form of a single-piece air expeller forming a pump chamber and a deformable actuator wall for actuating the air pump.

In another practical embodiment, the dispenser module may comprise:

- a module body forming fastener means for fastening on the reservoir, and a bottom portion of the fluid duct;
- a cover forming reception means for receiving the applicator, and a top portion of the fluid duct; and
- a flexible sleeve that connects the module body to the cover so as to form between them the air pump, the flexible sleeve forming a deformable actuator wall for actuating the air pump.

Advantageously, the module body forms valve seats for a single-piece valve member respectively forming a one-way outlet valve connecting the air pump to the reservoir, and a one-way inlet valve connecting the outside to the air pump.

In both of the practical embodiments, all of the component elements of the dispenser are mounted along a single axis, namely the longitudinal axis X.

According to another advantageous characteristic, the air pump extends beside, or all around, the fluid duct.

Finally, it may be advantageous to make the fluid reservoir out of a transparent material, without a dip tube, nor a follower piston.

The spirit of the invention resides in using an air pump for putting the reservoir under pressure, the air pump being incorporated in a module on which there are mounted both the reservoir and the applicator, such that the fluid coming from the reservoir passes through the module in order to reach the applicator. Using a "dual-flow" valve in order to manage the inlet of air into the air pump and the outlet of air therefrom is particularly advantageous.

The invention is described below in greater detail with reference to the accompanying drawings, which show two embodiments of the invention as non-limiting examples.

Reference is made to FIGS. 1 to 4 in order to describe in detail the various component elements of the fluid dispenser in the first embodiment of the invention.

Figure 1:
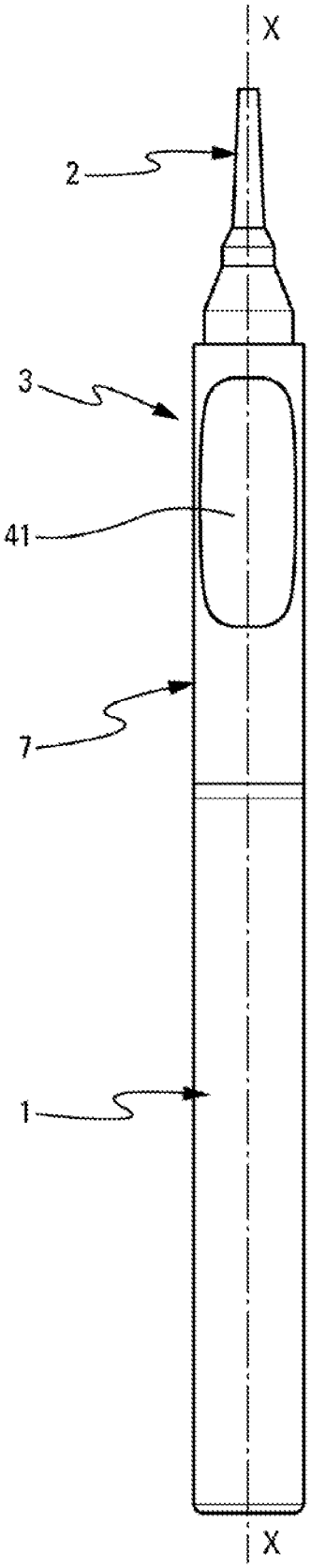
FIG. 1 is a front view of a fluid dispenser in a first embodiment of the invention.
Figure 2:
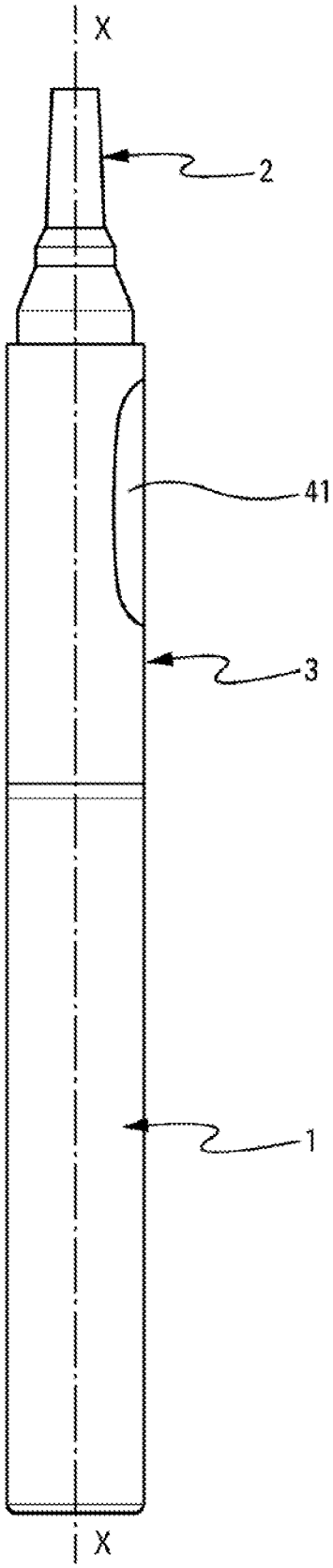
FIG. 2 is a side view of the FIG. 1 dispenser.

With reference to FIGS. 1 and 2, it should immediately be observed that the dispenser presents a shape that is generally elongate along a longitudinal axis X. The dispenser generally resembles a ball-point pen or a felt-tip pen. It should also be observed that the dispenser is wider in FIG. 1 than in FIG. 2, such that its cross-section is oblong, egg-shaped, or ellipsoidal. It should also be observed that the dispenser generally comprises three portions, namely a reservoir 1 that is situated in the bottom portion, an applicator 2 that is situated in the top portion, and a dispenser module 3 that is situated axially between the reservoir 1 and the applicator 2. More precisely, at its top portion the reservoir 1 is connected to the module 3, and at its bottom portion the applicator 2 is also connected to the module 3. It should be observed that the dispenser module 3 includes a deformable actuator wall 41 that is situated where the dispenser has its greatest curvature.

The fluid reservoir 1 may be made from any appropriate material, and preferably from a transparent or translucent material, so that it is possible to see the fluid that it contains. The reservoir 1 presents a configuration that is elongate along the longitudinal axis X and that defines at one end a bottom that is closed and at its other end a neck 11.

In this embodiment, the applicator 2 is in the form of an endpiece that is elongate along the longitudinal axis X. The applicator 2 includes a fastener stub 21 that is engaged with the dispenser module, as described below. The applicator 2 also includes an internal channel 22 that is terminated by a dispenser orifice 23 that is situated at the top end of the applicator. It is possible to use any appropriate material to make the applicator 2, and advantageously a flexible material that imparts a certain amount of deformability to the applicator. This is merely one particular and non-limiting embodiment: Specifically, the applicator may be of any kind, without going beyond the ambit of the invention. The applicator could also be in the form of a piece of porous material, a spatula, or a brush. In themselves, the nature and the function of the applicator 2 are not critical to the present invention, providing the applicator includes a fastener stub 21 suitable for engaging with the dispenser module 3.

In this first embodiment of the invention, the dispenser module 3 comprises four component elements, namely an air pump 4, a module body 5, a single-piece valve member 6, and a cover 7.

In this embodiment, the air pump 4 is in the form of a single-piece air expeller that may be made by blow-molding, for example. At is bottom end, the pump 4 defines an opening 42, and laterally it is provided with a deformable actuator wall 41 that advantageously projects therefrom. The inside of the pump 4 forms a pump chamber 40.

The module body 5 may advantageously be made as a single piece, and at its bottom end it includes a fastener skirt 51 for coming into sealing engagement with the neck 11 of the reservoir 1. Inside the fastener skirt 51, the module body 5 defines an air outlet channel 52 and a fluid inlet well 53, which are arranged substantially side by side. At its top end, the air outlet channel 51 communicates with a valve housing 56 in which the single-piece valve member 6 is received. More precisely, with reference to FIG. 3, it can be seen that the valve housing 56 defines two distinct valve seats 561 and 562 that co-operate with the single-piece valve member 6 so as to define an air outlet valve and an air inlet valve. The two valve seats 561 and 562 of the valve housing 56 are substantially coaxial, and the single-piece valve member 6 includes an outer movable lip 62 and an inner movable lip 61. The inner movable lip 61 together with the inner valve seat 561 constitute the air outlet valve, while the outer movable lip 62 together with the outer valve seat 562 form the air inlet valve that is fed with outside air from a vent passage 57.

In addition, the outlet well 53 communicates downstream with a fluid duct 54 that leads to the applicator 2, as described below.

Figure 3:
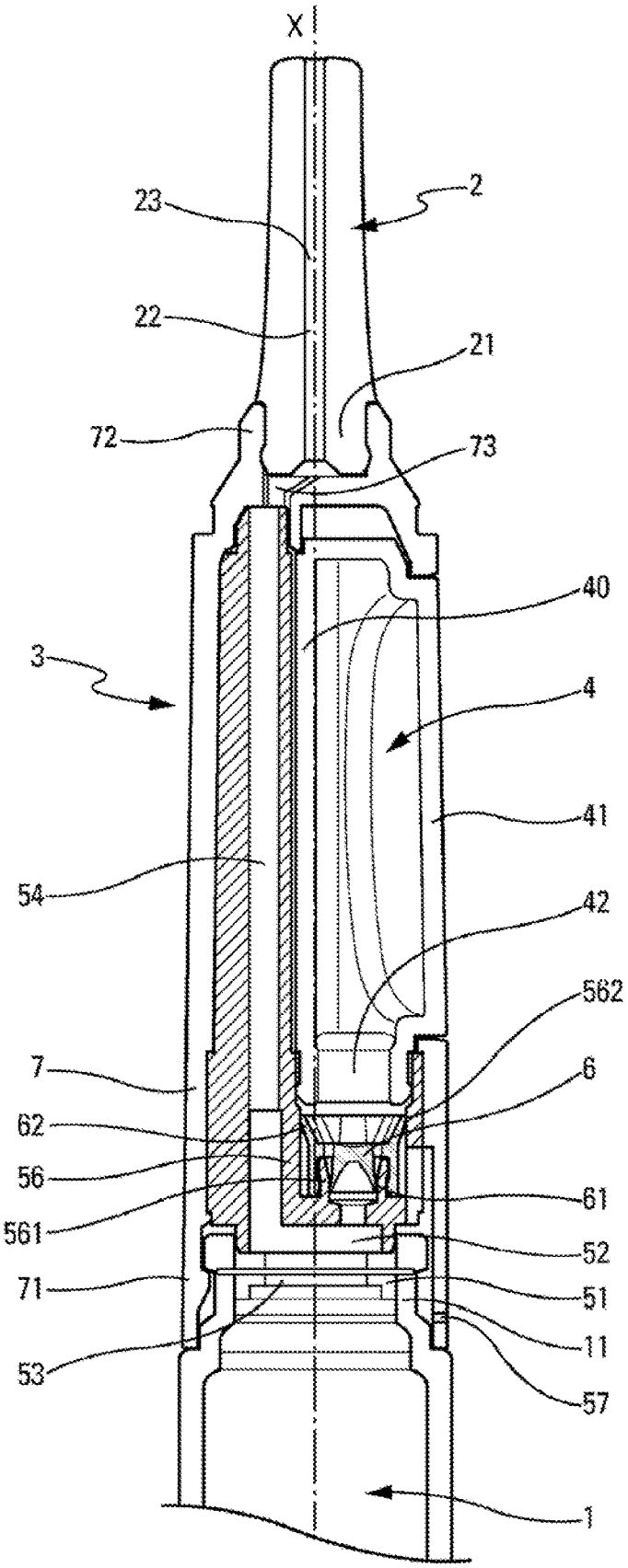
FIG. 3 is a vertical section view through the FIG. 2 dispenser.
Figure 4:
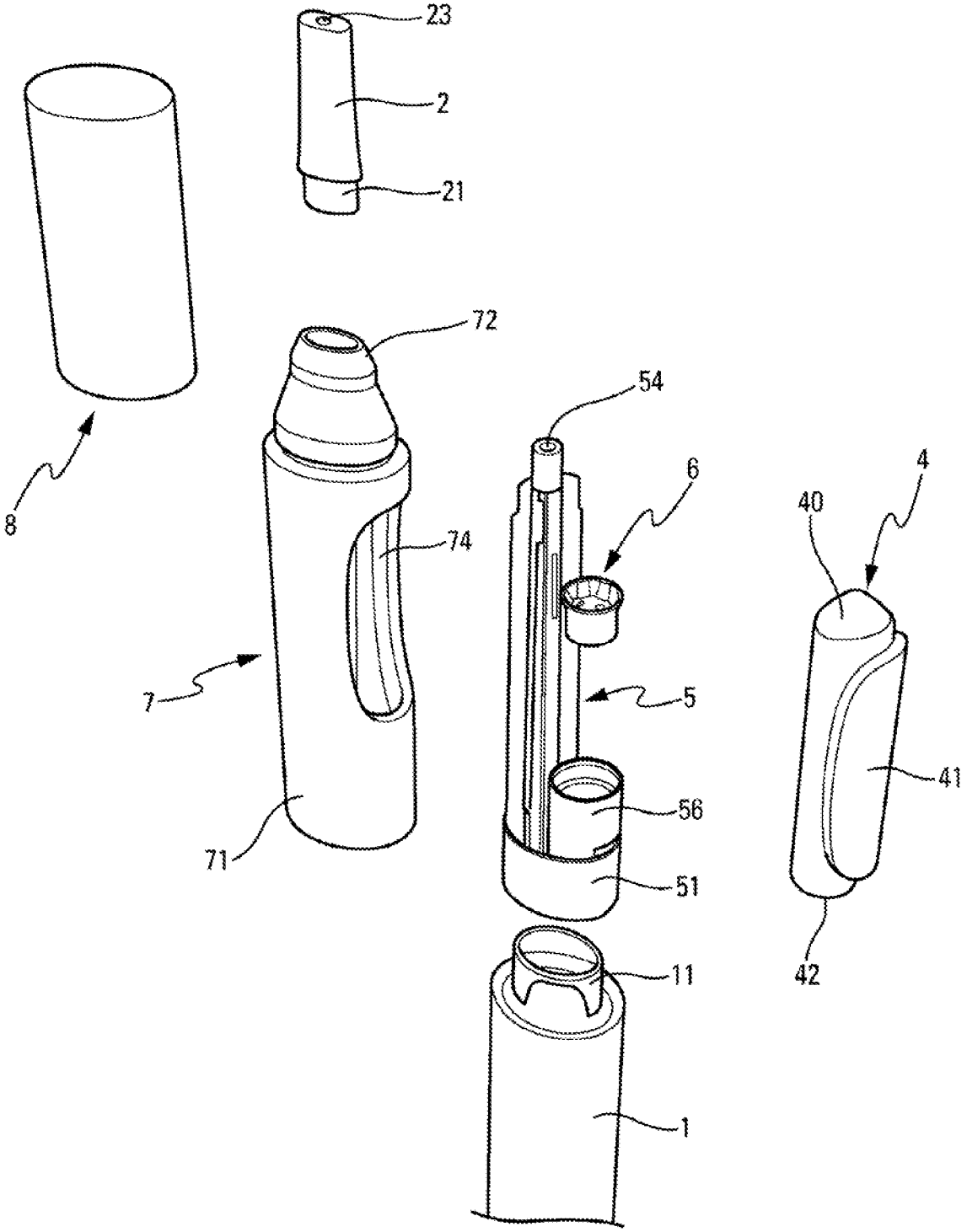
FIG. 4 is an exploded view of the dispenser in the above figures.

In FIG. 3, it can be seen that the pump 4 is mounted on the module body 5 with its opening 42 engaged in the valve housing 56. It should be observed that the pump 4 extends beside the fluid duct 54.

The cover 7 is in the form of a single-piece hollow body that receives the module body 5, the pump 4, and the single-piece valve member 6. At its bottom end, the cover 7 defines a reception housing 71 in which the neck 11 of the reservoir 1 is received, advantageously by snap-fastening. At its top end, the cover 7 defines an anchor housing 72 in which the anchor stub 21 of the applicator 2 is received, advantageously by snap-fastening. At the bottom of the anchor housing 72 there is formed a through hole 73 that puts the fluid duct 54 into communication with the outlet channel 22 of the applicator 2. Laterally, the cover 7 defines a large slot 74 in which the deformable actuator wall 41 of the pump 4 comes to be housed, as can be seen in FIGS. 1, 2, and 3.

Optionally, the dispenser includes a protective cap 8 that may be snap-fastened in removable manner on the cover 7, so as to mask and protect the applicator 2.

The dispenser functions as follows: the user initially takes hold of the dispenser in one hand, holding the cover 7 between the thumb and the middle finger so as to be able to position the index finger on the deformable actuator wall 41. In use, the reservoir 1 is situated higher than the applicator 2, so that the fluid is present at the outlet well 53. By pressing on the deformable actuator wall 41, the air contained in the pump 4 is forced through the opening 42, then forces the air outlet valve to open, so as to be forced through the air outlet channel 52 into the reservoir 1. Bringing air under pressure into the reservoir in this way causes the fluid that it contains to be put under pressure, so that a portion of the fluid is then forced through the fluid duct 54, and then the through hole 73, so as to arrive in the outlet channel 22 of the applicator 2. Once the fluid has been dispensed from the dispenser orifice 23, the user can apply the fluid to the desired surface, such as the skin.

When the user relaxes the pressure on the deformable actuator wall 41, said deformable actuator wall resiliently returns into its rest position, thereby creating suction inside the pump 4. This suction causes the air inlet valve to open, such that outside air can penetrate into the dispenser via the vent passage 57. The reservoir 1 is not subjected to any suction, since the air outlet valve is closed.

By pressing on the deformable actuator wall 41, the user is not even aware that air is being expelled into the reservoir, with fluid consequently being forced through the duct 54. At most, it may be observed that air bubbles are released into the fluid contained in the reservoir. This occurs particularly when the reservoir is made out of a transparent material. It can also be observed that the reservoir includes neither a dip tube, nor a follower piston. The air under pressure thus rises into the reservoir 1, and the fluid under pressure descends from the reservoir towards the applicator 2 through the duct 54. The dispenser module 3 thus enables the flow of air and the flow of fluid to cross past each other.

Figure 5:
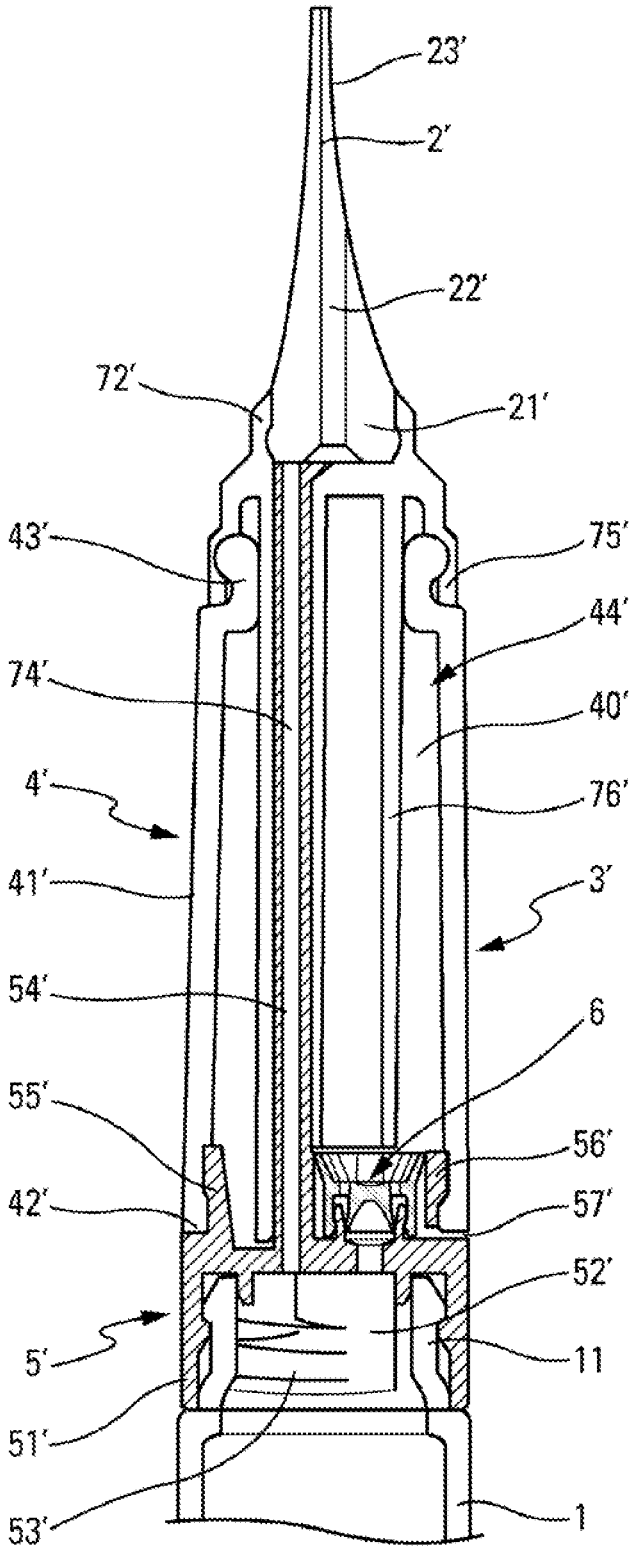
FIG. 5 is a view similar to the view in FIG. 3, showing a second embodiment of the invention.
Figure 6:
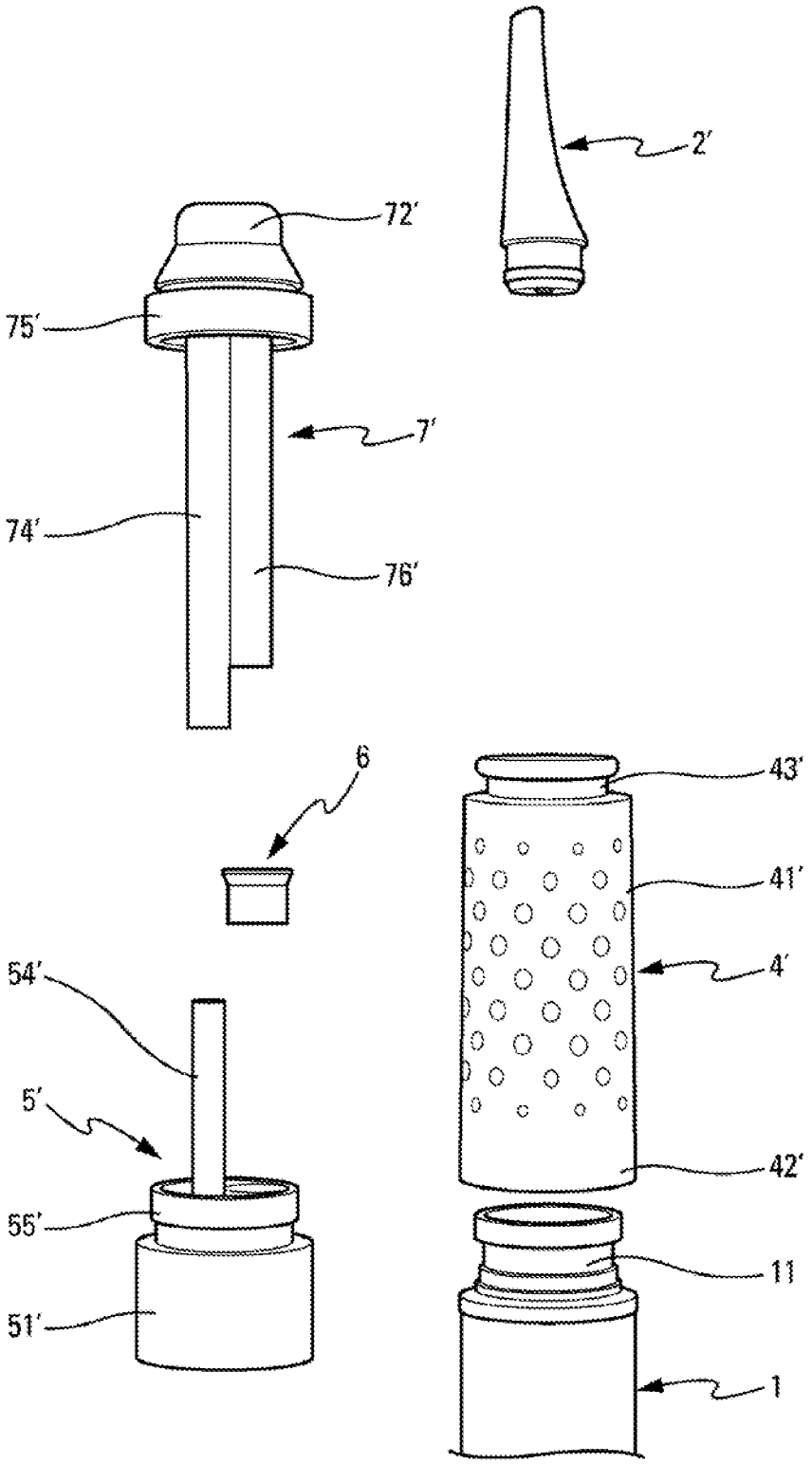
FIG. 6 is an exploded view of the FIG. 5 dispenser.

Reference is made to FIGS. 5 and 6 which show a second embodiment in which the reservoir 1 and the single-piece valve member 6 may be strictly identical to those of the first embodiment in FIGS. 1 to 4. The applicator 2' also presents a configuration that is a little different, being in the form of a spatula with a dispenser orifice 23' that opens out laterally.

The essential difference compared to the first embodiment resides in the structure of the dispenser module 3', and in particular of the air pump 4' and of the fluid duct that connects the reservoir to the applicator.

The dispenser module 3' also includes a module body 5' that defines a fastener skirt 51' that is in engagement with, and advantageously snap-fastened to, the neck 11 of the reservoir. The inside of the skirt 51' also defines an air outlet channel 52' and a fluid outlet well 53'. The body 5' also defines a housing 56' for the single-piece valve member 6. Furthermore, the body 5' defines a sealing fastener flange 55' having a function that is explained below. Finally, the body 5' includes a tube segment 58' that defines the bottom portion of a fluid duct 54' that extends upwards from the well 53' until it reaches the applicator 2'.

The cover 7' also defines an anchor housing 72' in which the anchor stub 21' of the applicator 2' is received, advantageously by snap-fastening. The cover defines a sealing fastener collar 75', having a function that is defined below. The cover 7' forms a pipe 74' that defines the top portion of the fluid duct 54'. The pipe 74' is engaged around the tube segment 58'. The pipe 74' opens out into the anchor housing 72'. The pipe 74' and the tube segment 58' co-operate with each other to form the fluid duct 54' that connects the well 53' to the housing 72'. Furthermore, the cover 7' forms a tube 76' that extends around the pipe 74', or, in a variant, the pipe 74' extends inside the tube 76'. The function of the tube 76' is explained below.

The dispenser module 3' also includes a flexible sleeve 4' having a bottom end 42' that is in sealing engagement with the flange 55', and having a top end 43' that is in sealing engagement with the collar 75'. Between its two ends, the flexible sleeve 4' forms a deformable actuator wall 41'. As can be seen in FIG. 5, the flexible sleeve 4' surrounds the pipe 74' and the tube 76'. An air pump 44' is thus defined by the sleeve 4', the module body 5', and the cover 7'. The pump 44' defines a chamber 40' of circularly-cylindrical shape.

The operation of the dispenser in this second embodiment is generally the same as for the dispenser of the first embodiment. Specifically, when a user squeezes the deformable actuator wall 41', air is put under pressure inside the sleeve 4'. The air outlet valve opens, such that the flow of air passes through the outlet channel 52' and arrives in the reservoir 1. Consequently, the pressure of the fluid stored in the reservoir 1 increases, and a portion of the fluid is forced through the well 53, and then through the tube segment 58' and the pipe 74' in order to arrive in the outlet channel 22' of the applicator 2'. The fluid is dispensed via the dispenser orifice 23', and the user can apply the fluid to the desired surface. When the user relaxes the pressure on the deformable actuator wall 41', outside air penetrates into the dispenser via the vent hole 57' and opens the air inlet valve so as to re-establish atmospheric pressure inside the flexible sleeve 4'.

In this second embodiment, it is possible to actuate the air pump by deforming the deformable actuator wall 41' between the thumb and the index finger. This is possible given that the sleeve 41' is cylindrical, and the deformable actuator wall 41' consequently extends all around the dispenser module 3'. However, deformation of the wall 41' is limited by the tube 76'.

The invention thus provides a fluid dispenser/applicator that may be in the form of a pen, with a laterally-actuated wall that does not act directly on the fluid, but acts by means of air that is put under pressure in an air pump. The air chamber of the air pump may extend beside the fluid channel that connects the reservoir to the applicator, or, in a variant, it may extend all around this duct, as in the second embodiment of the invention. The advantage of this air pump also resides in the fact that the reservoir 1 can contain only fluid, and does not require a dip tube nor a follower piston. The dispenser module 3 or 3' of the invention may be arranged between any reservoir and any applicator.

The invention claimed is:

1. A fluid dispenser comprising:

a fluid reservoir;

an applicator; and a dispenser module that is arranged between the reservoir and the applicator; wherein the dispenser module includes an air pump for sending air into the reservoir, and a fluid duct connecting the reservoir to the applicator wherein the air pump connects the fluid reservoir through a one-way outlet valve; wherein the air pump connects to air outside of the device through a one-way inlet valve; and wherein the one-way outlet valve and the one-way inlet valve are formed by a single-piece valve member.

2. The fluid dispenser according to claim 1, wherein the dispenser module includes reception housings in which the fluid reservoir and the applicator are respectively received.

3. The fluid dispenser according to claim 1, presenting a configuration that is elongate along a longitudinal axis X, the reservoir, the applicator, and the dispenser module extending along the longitudinal axis X, with the dispenser module interposed between the reservoir and the applicator.

4. The fluid dispenser according to claim 1, wherein the air pump includes a deformable actuator wall.

5. The fluid dispenser according to claim 1, wherein the air pump comprises a single piece forming a pump chamber and a deformable actuator wall.

6. A fluid dispenser according to claim 1, wherein the air pump extends beside, or all around, the fluid duct.

7. A fluid dispenser according to claim 1, wherein the reservoir is transparent and does not have a dip tube.

8. A fluid dispenser comprising: a fluid reservoir; an applicator; and a dispenser module that is arranged between the reservoir and the applicator; wherein the dispenser module includes an air pump for sending air into the reservoir, and a fluid duct connecting the reservoir to the applicator, wherein the dispenser module comprises:

a module body forming the fluid duct and fastener means for fastening on the reservoir;

a cover forming reception means for receiving the applicator; and the air pump in the form of a single-piece air expeller forming a pump chamber and a deformable actuator wall for actuating the air pump.

9. A fluid dispenser according to claim 8, wherein the module body forms valve seats for a single-piece valve member respectively forming a one-way outlet valve connecting the air pump to the reservoir, and a one-way inlet valve connecting the outside to the air pump.

10. The fluid dispenser according to claim 8, wherein the dispenser module includes reception housings in which the fluid reservoir and the applicator are respectively received.

11. The fluid dispenser according to claim 8, presenting a configuration that is elongate along a longitudinal axis X, the reservoir, the applicator, and the dispenser module extending along the longitudinal axis X, with the dispenser module interposed between the reservoir and the applicator.

12. The fluid dispenser according to claim 8, wherein the air pump comprises a single piece forming a pump chamber.

13. The fluid dispenser according to claim 8, wherein the air pump extends beside, or all around, the fluid duct.

14. The fluid dispenser according to claim 8, wherein the reservoir is transparent and does not have a dip tube.

15. A fluid dispenser comprising: a fluid reservoir; an applicator; and a dispenser module that is arranged between the reservoir and the applicator; wherein the dispenser module includes an air pump for sending air into the reservoir, and a fluid duct connecting the reservoir to the applicator, wherein the dispenser module comprises:

a module body forming fastener means for fastening on the reservoir, and a bottom portion of the fluid duct;

a cover forming reception means for receiving the applicator, and a top portion of the fluid duct; and a flexible sleeve that connects the module body to the cover so as to form between the module body and the cover the air pump, the flexible sleeve forming a deformable actuator wall for actuating the air pump.

16. The fluid dispenser according to claim 15, wherein the module body forms valve seats for a single-piece valve member respectively forming a one-way outlet valve connecting the air pump to the reservoir, and a one-way inlet valve connecting the outside to the air pump.

17. The fluid dispenser according to claim 15, wherein the dispenser module includes reception housings in which the fluid reservoir and the applicator are respectively received.

18. The fluid dispenser according to claim 15, presenting a configuration that is elongate along a longitudinal axis X, the reservoir, the applicator, and the dispenser module extending along the longitudinal axis X, with the dispenser module interposed between the reservoir and the applicator.

19. The fluid dispenser according to claim 15, wherein the air pump comprises a single piece forming a pump chamber and a deformable actuator wall.

20. The fluid dispenser according to claim 15, wherein the air pump extends beside, or all around, the fluid duct.

21. The fluid dispenser according to claim 15, wherein the reservoir is transparent and does not have a dip tube.

* * * * *